US006153087A

United States Patent [19]

Bigeard et al.

[11] Patent Number: 6,153,087

[45] Date of Patent: Nov. 28, 2000

[54] PROCESS FOR CONVERTING HEAVY CRUDE OIL FRACTIONS, COMPRISING AN EBULLATING BED CONVERSION STEP AND A HYDROCRACKING STEP

[75] Inventors: Pierre-Henri Bigeard, Vienne; Frédéric Morel, Francheville; Christophe Gueret, Vienne; Patrick Briot, Vienne; Pierre Marion, Paris, all of France

[73] Assignee: Institut Francais du Petrole, Rueil-Malmaison Cedex, France

[21] Appl. No.: 09/103,526

[22] Filed: Jun. 24, 1998

[30] Foreign Application Priority Data

Jun. 24, 1997 [FR] France ..... 97/07984

[51] Int. Cl.[7] ..... C10G 69/02

[52] U.S. Cl. ..... 208/89; 208/86; 208/58; 208/210; 208/213

[58] Field of Search ..... 208/86, 89, 61, 208/58, 210, 213

[56] References Cited

U.S. PATENT DOCUMENTS

| | | | |
|---|---|---|---|
| 3,278,415 | 10/1966 | Doberenz et al. | 208/45 |
| 3,297,563 | 1/1967 | Doumani | 208/59 |
| 3,364,133 | 1/1968 | Young et al. | 208/89 |
| 3,725,247 | 4/1973 | Johnson et al. | 208/111 |
| 3,725,251 | 4/1973 | Alpert et al. | 208/210 |
| 3,728,251 | 4/1973 | Kelley et al. | 208/89 |
| 3,887,455 | 6/1975 | Hamner et al. | 208/112 |
| 3,972,803 | 8/1976 | Wolk et al. | 208/97 |
| 4,376,037 | 3/1983 | Dahlberg et al. | 208/111 |
| 4,478,705 | 10/1984 | Ganguli | 208/59 |
| 4,746,419 | 5/1988 | Peck et al. | 208/213 |
| 5,108,580 | 4/1992 | Nongbri et al. | 208/61 |
| 5,384,297 | 1/1995 | Prada et al. | 502/66 |
| 5,591,325 | 1/1997 | Higashi | 208/251 H |
| 5,624,547 | 4/1997 | Sudhakar et al. | 208/89 |

FOREIGN PATENT DOCUMENTS

| | | |
|---|---|---|
| 1 495 586 | 12/1977 | United Kingdom . |
| 2 104 544 | 3/1983 | United Kingdom . |
| 2 160 889 | 1/1986 | United Kingdom . |

*Primary Examiner*—Walter D. Griffin

*Attorney, Agent, or Firm*—Millen, White, Zelano & Branigan

[57] ABSTRACT

A process for converting a hydrocarbon fraction comprises a step a) for treating a hydrocarbon feed in the presence of hydrogen in at least one three-phase reactor, containing at least one hydrotreatment catalyst in an ebullating bed, operating in riser mode of liquid and of gas, the reactor comprising at least one means located close to the bottom of the reactor for extracting catalyst from the reactor and at least one means located close to the top of the reactor for adding fresh catalyst to the reactor, a step b) for treating at least a portion of the effluent from step a) in the presence of hydrogen in at least one reactor containing at least one hydrocracking catalyst in a fixed bed under conditions for producing an effluent with a reduced sulphur content, and a step c) in which at least a portion of the product from step b) is sent to a distillation zone from which a gaseous fraction, a gasoline type engine fuel fraction, a diesel type engine fuel fraction and a liquid fraction which is heavier than the diesel type fraction are recovered. The process can also comprise a step d) for catalytic cracking of the heavy fraction obtained from step c).

21 Claims, No Drawings

PROCESS FOR CONVERTING HEAVY CRUDE OIL FRACTIONS, COMPRISING AN EBULLATING BED CONVERSION STEP AND A HYDROCRACKING STEP

FIELD OF THE INVENTION

The present invention relates to refining and converting heavy fractions of hydrocarbon distillates containing sulphur-containing impurities, inter alia. More particularly, it relates to a process for converting at least a portion of a hydrocarbon feed, for example a vacuum distillate obtained by straight-run distillation of a crude oil into good quality light gasoline and diesel fractions and into a heavier product which can be used as a feed for catalytic cracking in a conventional fluidised bed catalytic cracking unit and/or in a fluidised bed catalytic cracking unit comprising a double regeneration system and possibly a system for cooling the catalyst at the regeneration stage. In one aspect, the present invention relates to a process for the production of gasoline and/or diesel comprising at least one fluidised bed catalytic cracking step.

One of the aims of the present invention is to produce, from certain particular hydrocarbon fractions which will be defined in the following description, by means of partial conversion of those fractions, lighter fractions which can easily be upgraded such as middle distillates (engine fuels: gasoline and diesel) and base oils.

Within the context of the present invention, the degree of conversion of the feed into lighter fractions is normally in the range 20% to 95%, or even 100% when the unconverted heavy fraction is recycled, usually in the range 25% to 90%.

Various Feeds

The feeds treated in the present invention are straight run vacuum distillates, vacuum distillates from a conversion process such as those from coking, from fixed bed hydroconversion such as those from HYVAHL® processes for treating heavy fractions developed by ourselves, or from ebullating bed heavy fraction hydrotreatment processes such as those from H-OIL® processes, or from solvent deasphalted oils, for example propane, butane or pentane deasphalted oils originating from deasphalting a straight run vacuum residue or vacuum residues from HYVAHL® or H-OIL® processes. The feeds can also be formed by mixing those various fractions in any proportions in particular deasphalted oil and vacuum distillate. They can also contain light cycle oil (LCO) of various origins, high cycle oil (HCO) of various origins and diesels from catalytic cracking generally having a distillation range of about 150° C. to about 370° C. They can also contain aromatic extracts and paraffins obtained from the manufacture of lubricating oils.

Final Products

The aim of the present invention is to produce good quality products in particular with a low sulphur content under relatively low pressure conditions, to limit the necessary investment costs. This process can produce a gasoline type engine fuel containing less than 100 ppm by weight of sulphur thus satisfying the most seyere specifications as regards sulphur content for this type of fuel, and this can be achieved using a feed which may contain more than 3% by weight of sulphur. Similarly, and this is particularly important, a diesel type engine fuel is obtained with a sulphur content much lower than 500 ppm and a residue with an initial boiling point which is, for example, about 370° C. which can be sent as a feed or part of a feed to a conventional catalytic cracking step or to a residue catalytic cracking reactor such as a double regeneration reactor, preferably to a conventional catalytic cracking reactor.

Prior Art

The prior art, in particular United States patents U.S. Pat. No. 4,344,840 and U.S. Pat. No. 4,457,829, describes processes for treating heavy hydrocarbon cuts comprising a first treatment step carried out in the presence of hydrogen in a reactor containing an ebullating bed of catalyst followed by a second step of fixed bed hydrotreatment. The descriptions illustrate the case of fixed bed treatment in the second step of a light gas fraction of the product from the first step. We have now discovered, and this constitutes one of the aims of the present invention, that it is possible in the second step to treat either the whole of the product from the first ebullating bed conversion step, or the liquid fraction from that step, recovering the gas fraction converted in that first step, under favourable conditions leading to good stability of the ensemble of the system and improved selectivity for middle distillate.

SUMMARY OF THE INVENTION

In its broadest aspect, the present invention is defined as a process for converting a hydrocarbon fraction with a sulphur content of at least 0.05%, normally at least 1% and usually at least 2% by weight and with an initial boiling point of at least 300° C., normally at least 320° C. and usually at least 340° C., and an end point of at least 400° C., normally at least 450° C. and which may reach 600° C. or even 700° C., characterized in that it comprises the following steps:

a) treating the hydrocarbon feed in a treatment section in the presence of hydrogen, said section comprising at least one three-phase reactor, containing at least one ebullating bed of hydrotreatment catalyst the mineral support of which is at least partially amorphous, functioning in riser mode for liquid and for gas, said reactor comprising at least one means located near the bottom of the reactor for extracting catalyst from said reactor and at least one means located near the top of said reactor for adding fresh catalyst to said reactor;

b) sending at least a portion, normally all, of the effluent from step a) to a section for treatment in the presence of hydrogen, said section comprising at least one reactor containing at least one fixed bed of hydrocarbon catalyst the mineral support of which is normally at least partially crystalline, under conditions for producing an effluent with a reduced sulphur content and a higher middle distillates content.

Normally, the treatment section of step a) comprises one to three reactors in series and the treatment section of step b) also comprises one to three reactors in series.

In a preferred implementation of the invention, at least a portion, normally all, of the effluent obtained from step b) is sent to a distillation zone (step c)) from which a gas fraction, a gasoline type engine fuel fraction, a diesel type engine fuel fraction and a liquid fraction which is heavier than the diesel type fraction are recovered.

In a variation, the heavier liquid fraction of the hydroconverted feed from step c) is sent to a catalytic cracking section (step d)) in which it is treated under conditions for recovering a gas fraction, a gasoline fraction, a diesel fraction and a slurry fraction.

In a further variation, at least a portion of the heavier fraction of the hydroconverted feed from step c) is sent either to hydrotreatment step a), or to hydrocracking step b), or to each of these steps. It is also possible to recycle all of that fraction.

The gas fraction obtained in steps c) or d) normally principally comprises saturated and unsaturated hydrocarbons containing 1 to 4 carbon atoms in their molecules (methane, ethane, propane, butanes, ethylene, propylene, butylenes). At lest a portion, preferably all, of the gasoline type fraction obtained in step c) is sent to the gasoline pool, for example. At least a portion of the diesel type fraction obtained in step c) is sent to the gasoline pool. At least a portion, preferably all, of the slurry fraction obtained from step d) is normally sent to the heavy fuel pool of the refinery, generally after separating out fine particles which it contains in suspension. In a further implementation of the invention, at least a portion, preferably all, of this slurry fraction is returned to the inlet to catalytic cracking step d). In a further implementation of the invention, at least a portion of this slurry fraction can be sent either to step a), or to step b), or to each of these steps, generally after separating out the fine particles it contains in suspension.

One particular implementation of the present invention comprises an intermediate step a1) between step a) and step b) in which the product from step a) is split into a heavy liquid fraction and a lighter fraction which is recovered. In this implementation of the present invention, the heavy liquid fraction obtained in step a1) is then sent to hydrocracking step b). This implementation enables better upgrading of the light fractions obtained from hydrotreatment step a) and limits the quantity of product to be treated in step b). The lighter fraction obtained in step a1) can be sent to a distillation zone from which a gas fraction, a gasoline type engine fuel fraction, a diesel type engine fuel fraction and a liquid fraction which is heavier than the diesel fraction are recovered at least part of which can, for example, be returned to step a) and/or at least part of which can be returned to hydrocracking step b). The distillation zone in which this lighter fraction is split can be distinct from the distillation zone of step c), but usually this lighter fraction is sent to the distillation zone of step c).

In a particular implementation, which may be a preferred implementation when the catalyst used in step a) tends to form fines which can eventually alter the operation of the fixed bed reactor of step b), it is possible to provide a separation step b1) to eliminate at least a portion of the fines before introducing the product from either step a) or step a1) into hydrocracking step b). This separation can be carried out using any means which is known to the skilled person. As an example, separation can be carried out using at least one centrifuging system such as a hydrocyclone, or at least one filter. The scope of the present invention encompasses direct separation of the product from step a) then sending the product which is depleted in fines to step a1), but this would involve treating a larger quantity of product than if separation were to be carried out on the liquid fraction from step a1) when it exists. In a particular implementation of step b1), at least two separation means are used in parallel, one being used to carry out separation while the other is purged of retained fines.

The conditions of step a) for treating the feed in the presence of hydrogen are normally conventional ebullating bed conditions for hydrotreating a liquid hydrocarbon fraction. An absolute pressure of 2 to 35 MPa, normally 5 to 20 MPa and usually 6 to 10 MPa is used with a temperature of about 300° C. to about 550° C., normally about 350° C. to about 500° C. The hourly space velocity (HSV) and partial pressure of hydrogen are important factors which are selected depending on the characteristics of the product to be treated and the desired conversion. The HSV is usually in a range of about 0.1 $h^{-1}$ to about 10 $h^{-1}$, preferably about 0.5 $h^{-1}$ to about 5 $h^{-1}$. The quantity of hydrogen mixed with the feed is usually about 50 to about 5000 normal cubic meters ($Nm^3$) per cubic meter ($m^3$) of liquid feed, usually about 100 to about 1000 $Nm^3/m^3$, preferably about 300 to about 500 $Nm^3/m^3$. A conventional granular hydrotreatment catalyst comprising at least one metal or metal compound with a hydro-dehydrogenating function on an amorphous support, may be used. This catalyst may be a catalyst comprising group VIII metals for example nickel and/or cobalt, usually combined with at least one group VIB metal, for example molybdenum and/or tungsten. A catalyst may be used which comprises, for example, 0.5% to 10% by weight of nickel, preferably 1% to 5% by weight of nickel (expressed as nickel oxide NiO) and 1% to 30% by weight of molybdenum, preferably 5% to 20% by weight of molybdenum (expressed as molybdenum oxide $MoO_3$) on an amorphous mineral support. The support can, for example, be selected from the group formed by alumina, silica, silica-aluminas, magnesia, clays and mixtures of at least two of these minerals. The support can also comprise other compounds, for example oxides selected from the group formed by boron oxide, zirconia, titanium oxide, and phosphorous anhydride. Usually, an alumina support is used, mainly an alumina support doped with phosphorous and possibly with boron. The concentration of phosphoric anhydride $P_2O_5$ is normally less than about 20% by weight, usually less than about 10% by weight. This $P_2O_5$ concentration is normally at least 0.001% by weight. The concentration of boron trioxide $B_2O_3$ is normally about 0 to about 10% by weight. The alumina used in normally a $\gamma$ or a $\eta$ alumina. This catalyst is usually in the form of extrudates. The total concentration of oxides of metals from groups VI and VIII is normally about 5% to about 40% by weight, generally about 7% to 30% by weight, and the weight ratio of the group VI metal(s) to the group VIII metal(s), expressed as the metal oxide, is generally about 20 to about 1, usually about 10 to about 2. Used catalyst is partially replaced by fresh or new catalyst at regular intervals for example, in batches or quasi-continuously. Fresh catalyst can be introduced every day, for example. The rate of replacing used catalyst with fresh catalyst can, for example, be about 0.05 kilograms to about 10 kilograms per cubic meter of feed. Extraction and replacement are carried out using apparatus which enable this hydrotreatment step to be carried out continuously. The unit normally comprises a recirculation pump which maintains the catalyst in an ebullating bed by continuously recycling at least a portion of the liquid extracted from the head of the reactor and re-injecting it at the bottom of the reactor. It is also possible to send used catalyst extracted from the reactor to a regeneration zone in which the carbon and sulphur contained in the catalyst is eliminated, then to send the regenerated catalyst to converting hydrotreatment step b). Usually, this hydrotreatment step a) is carried out under T-STAR® process conditions as described, for example, in the article "Heavy Oil Hydroprocessing", published by l'Aiche, Mar. 19–23, 1995, HOUSTON, Tex., paper number 42d. It can also be carried out under the conditions of the H-OIL® process as described, for example, in the article published by NPRA, Annual Meeting, Mar. 16–18, 1997, J. J. Colyar and L. I. Wilson, entitled "THE H-OIL® PROCESS: A WORLD-WIDE LEADER IN VACUUM RESIDUE HYDROPROCESSING".

The products obtained during step a) in the variation mentioned above (step a1)) are sent to a separation zone from which a heavy liquid fraction and a lighter fraction can be recovered. This heavy liquid fraction normally has an initial boiling point of about 350° C. to about 400° C., preferably about 360° C. to about 380° C., for example about 370° C. The lighter fraction is normally sent to a separation zone in which it is split into light gasoline and diesel fractions at least part of which can be sent to gasoline pools, and into a heavier fraction.

In step b), an absolute pressure of about 5 to 30 MPa is normally used, usually about 5 to 20 MPa and more usually about 7 to 15 MPa. The temperature in step b) is normally about 300° C. to about 500° C., usually about 350° C. to about 450° C., and more usually about 370° C. to about 400° C. This temperature is usually adjusted depending on the desired level of conversion. The hourly space velocity (HSV) and partial pressure of hydrogen are important factors which are selected as a function of the characteristics of the product to be treated and the desired conversion. The HSV is usually in a range of about 0.1 $h^{-1}$ to about 10 $h^{-1}$, usually about 0.1 $h^{-1}$ to about 5 $h^{-1}$ and preferably about 0.3 $h^{-1}$ to about 2 $h^{-1}$. The quantity of hydrogen mixed with the feed is normally about 50 to about 5000 normal cubic liters ($Nm^3$) per cubic meter ($m^3$) of liquid feed, usually about 100 to about 2000 $Nm^3/m^3$, and preferably about 150 to about 1000 $Nm^3/m^3$.

In the hydrocracking zone (step b)), at least one fixed bed of conventional hydrocracking catalyst is used, the support of which is preferably at least partially crystalline. Preferably, a catalyst is used the support of which contains at least one zeolite, or a zeolite mixture. The zeolite can optionally be doped with metallic elements such as metals from the rare earth family, in particular lanthanum or cerium, or noble or non noble metals from group VIII, such as platinum, palladium, ruthenium, rhodium, iridium, iron and other metals such as manganese, zinc, and magnesium.

A HY zeolite is particularly advantageous and is characterised by different specifications: a $SiO_2/Al_2O_3$ molar ratio in the range about 8 to 70, preferably in the range about 12 to 40: a sodium content of less than 0.15% by weight determined for zeolite calcined at 1100° C.; a lattice parameter a for the unit cell in the range $24.55\times10^{-10}$ m to $24.24\times10^{-10}$ m, preferably in the range $24.38\times10^{-10}$ m to $24.26\times10^{-10}$ m; a sodium take-up capacity CNa, expressed in grams of sodium (Na) per 100 grams of modified zeolite, neutralised then calcined, of over about 0.85; a specific surface area, determined using the BET method, of more than about 400 $m^2/g$, preferably over 550 $m^2/g$, a water vapour adsorption capacity at 25° C. for a partial pressure of 2.6 torrs (1 torr=1.333 millibars) of more than about 6%, a pore distribution in the range 1% to 20%, preferably in the range 3% to 15% of the pore volume contained in pores with a diameter of between $20\times10^{-10}$ m and $80\times10^{-10}$ m, the remainder of the pore volume being contained in pores with a diameter of less than $20\times10^{-10}$ m. The catalyst which is normally used also contains at least one amorphous mineral support acting as a binder and at least one metal or metal compound with a hydro-dehydrogenating function. The zeolite content is normally about 2% to about 80% by weight, preferably about 5% to about 50% by weight. This catalyst may be a catalyst comprising group VIII metals for example nickel and/or cobalt, usually in combination with at least one group VIB metal, for example molybdenum and/or tungsten. As an example, a catalyst comprising 0.5% to 10% by weight of nickel, preferably 1% to 5% by weight of nickel (expressed as nickel oxide NiO) and 1% to 30% by weight of molybdenum, preferably 5% to 20% by weight of molybdenum (expressed as molybdenum oxide $MoO_3$) can be used. The amorphous mineral support acting as a binder is, for example, selected from the group formed by alumina, silica, silica-aluminas, magnesia, silica-magnesias, clays and mixtures of at least two of these minerals. The support can also comprise other compounds, for example oxides selected from the group formed by boron oxide, zirconia, titanium oxide and phosphoric anhydride. Normally, an alumina support is used, usually an alumina support doped with phosphorous and possibly boron. The concentration of phosphoric anhydride $P_2O_5$ is normally less than about 20% by weight, usually less than about 10% by weight. This $P_2O_5$ concentration is normally at least 0.001% by weight. The concentration of boron trioxide $B_2O_3$ is normally about 0 to about 10% by weight. The alumina used in normally a $\gamma$ or a $\eta$ alumina. This catalyst is usually in the form of extrudates or beads. The total concentration of oxides of metals from groups VI and VIII is normally about 1% to about 40% by weight, generally about 3% to 30% by weight, and the weight ratio of the group VI metal(s) to the group VIII metal(s) is generally about 20 to about 1, usually about 10 to about 2, expressed as the metal oxide. As an example one of the catalysts described in our French patent document FR-A-2 582 543, European patent EP-B-0 162 733 or U.S. Pat. No. 4,738,940 can be used.

In the distillation zone of step c), the conditions are generally selected so that the cut point for the heavy feed is about 350° C. to about 400° C., preferably about 360° C. to about 380° C., for example about 370° C. In this distillation zone, a gasoline fraction with an end point which is usually about 150° C. and a diesel fraction with an initial boiling point which is usually about 150° C. and an end point of about 370° C. are recovered.

Finally, in a variation mentioned above, in a catalytic cracking step d) at least a portion of the heavy fraction of the hydrotreated feed obtained in step c) can be sent to a conventional catalytic cracking section in which it is conventionally catalytically cracked under conditions which are well known to the skilled person to produce a fuel fraction (comprising a gasoline fraction and a diesel fraction) at least a portion of which is normally sent to gasoline pools, and a slurry fraction at least a portion, preferably all, of which is sent to a heavy fuel pool, for example, or at least a portion, preferably all, of which is recycled to catalytic cracking step d). Within the context of the present invention, the expression "catalytic cracking" encompasses cracking processes comprising at least one partial combustion regeneration step and those comprising at least one total combustion regeneration step and/or those comprising both at least one partial combustion step and at least one total combustion step. In a particular implementation of the invention, a portion of the diesel fraction obtained during this step d) is recycled either to step a), or to step b) or to step d) mixed with the feed introduced into catalytic cracking step d). In the present description the term "a portion of the diesel fraction" means a fraction of less than 100%. The scope of the present invention encompasses recycling a portion of the diesel fraction to step a), a portion to step b) and a further portion to step d), the ensemble of these portions, not necessarily adding up to the whole of the diesel fraction. It is also possible to recycle all of the diesel obtained by catalytic cracking either to step a), or to step b) or to step d), or a fraction to each of these steps, the sum of the fractions representing 100% of the diesel fraction obtained in step d). At least a portion of the gasoline fraction obtained in catalytic cracking step d) can also be recycled to step d).

A summary description of catalytic cracking (the first industrial use goes back to 1936 (HOUDRY process) or to 1942 for the use of a fluidised bed of catalyst) in ULLMANS ENCYCLOPEDIA OF INDUSTRIAL CHEMISTRY VOLUME A 18, 1991, pages 61 to 64. A conventional catalyst is normally used, comprising a matrix, an optional additive, and at least one zeolite. The quantity of zeolite is variable but is normally about 3% to 60% by weight, usually about 6% to 50% by weight and more usually about 10% to 45% by weight. The zeolite is normally dispersed in the matrix. The quantity of additive is normally about 0 to 30% by weight, usually about 0 to 20% by weight. The quantity of matrix represents the complement to 100% by weight. The additive is generally selected from the group formed by oxides of metals from group IIA of the periodic table such as magnesium oxide or calcium oxide, rare earth oxides and titanates of group IIA metals. The matrix is usually a silica, an alumina, a silica-alumina, a silica-magnesia, a clay or a mixture of two or more of these products. The most frequently used zeolite is Y zeolite. Cracking is carried out in a substantially vertical reactor either in riser or in dropper mode. The choice of catalyst and the operating conditions are functions of the desired products depending on the feed treated as described, for example, in the article by M. MARCILLY, pages 990–991, published in the Institut Francais du Pétrole review, November–December 1975, pages 969–1006. The temperature is normally about 450° C. to about 600° C. and the residence times in the reactor are less than 1 minute, usually about 0.1 to about 50 seconds.

The catalytic cracking step d) can also be a fluidised bed catalytic cracking step, for example using the process known as R2R developed by us. This step can be carried out in conventional fashion as known to the skilled person under conditions suitable for cracking in view of producing lower molecular weight hydrocarbon products. Descriptions of the operation and catalysts for use in this context of fluidised bed cracking in this step d) are described, for example, in patents U.S. Pat. No. 4,695,370, EP-B-0 184 517, U.S. Pat. No. 4,959,334, EP-B-0 323 297, U.S. Pat. No. 4,965,232, U.S. Pat. No. 5,120,691, U.S. Pat. No. 5,344,554, U.S. Pat. No. 5,449,496, EP-A-0 485 259, U.S. Pat. No. 5,286,690, U.S. Pat. No. 5,324,696 and EP-A-0 699 224, the descriptions of which are hereby incorporated into the present description by reference.

The fluidised bed catalytic cracking reactor can operate in riser or dropper mode. Although it is not a preferred implementation of the present invention, it is also possible to carry out catalytic cracking in a moving bed reactor. Particularly preferred catalytic cracking catalysts are those containing at least one zeolite normally mixed with a suitable matrix such as alumina, silica, or silica-alumina.

In a particular implementation, when the treated feed is a vacuum distillate from vacuum distillation of an atmospheric distillation residue of a crude oil it is advantageous to recover the vacuum residue to send it to a solvent deasphalting step f) from which an asphalt fraction is recovered and a deasphalted oil is recovered which is sent, for example, at least in part to hydrotreatment step a) mixed with the vacuum distillate.

Solvent deasphalting step f) is carried out under conventional conditions which are well known to the skilled person. Reference should be made in this respect to the article by BILLON et al published in 1994 in volume 49, number 5 of the Institut Francais du Pétrole review, pages 495 to 507, or to the description given in the description in French patent FR-B-2 480 773, or to the description in our patent FR-B-2 681 871, or to the description of our patent U.S. Pat. No. 4,715,946, the descriptions of which are hereby incorporated by reference. Deasphalting is normally carried out at a temperature of 60° C. to 250° C. with at least one hydrocarbon solvent containing 3 to 7 carbon atoms, possibly with the addition of at least one additive. Suitable solvents and additives have been widely described in the documents cited above and in patent documents U.S. Pat. No. 1,948,296, U.S. Pat. No. 2,081,473, U.S. Pat. No. 2,587,643, U.S. Pat. No. 2,882,219, U.S. Pat. No. 3,278,415 and U.S. Pat. No. 3,331,394, for example. It is also possible to recover solvent using an opticritical process, i.e., using a solvent under supercritical conditions. This process can in particular substantially improve the overall economics of the process. Deasphalting can be carried out in a mixer-settler or in an extraction column. In the context of the present invention, a technique using at least one extraction column is preferred.

In a preferred implementation of the invention, the residual asphalt obtained from step f) is sent to an oxyvapogasification section in which is transformed into a gas containing hydrogen and carbon monoxide. This gas mixture can be used to synthesise methanol or to synthesise hydrocarbons using the Fischer-Tropsch reaction. In the context of the present invention, this mixture is preferably sent to a shift conversion section in which it is converted to hydrogen and carbon dioxide in the presence of steam. The hydrogen obtained can be used in steps a) and b) of the process of the invention. The residual asphalt can also be used as a solid fuel or, after fluxing, as a liquid fuel, or can form part of a bitumen composition.

EXAMPLES

These examples were carried out in a pilot unit which differed from an industrial unit in that the flow of fluids in the fixed bed hydrocracking zone was carried out in riser mode. It has been shown elsewhere that this mode of operating a pilot unit provides results which are equivalent to those of industrial units operating in fluid dropper mode.

Example 1 (comparative)

An amorphous catalyst containing 15% by weight of Mo expressed as molybdenum oxide $MoO_3$, 5% by weight of Ni expressed as nickel oxide NiO and 80% by weight of alumina was charged into a first fixed bed reactor; a catalyst with the following composition: 12% Mo expressed as molybdenum oxide $MoO_3$, 4% by weight of Ni expressed as nickel oxide NiO, 10% by weight of Y zeolite and 74% by weight of alumina, was charged into a second fixed bed reactor located after the first reactor.

A feed was introduced which was constituted by a vacuum distillate with the composition given in Table 1.

TABLE 1

| | Feed |
|---|---|
| d 15/4 | 0.926 |
| Viscosity @ 100° C. ($m^2/s$) | $10.1 \times 10^{-4}$ |
| Sulphur (weight %) | 2.58 |
| Nitrogen (ppm) | 1300 |
| Distillation | |
| 5% | 393 |
| 95% | 565 |

Hydrogen was introduced at a pressure of 13.5 MPa and in a $H_2$/HC ratio of 1300 by volume. The space velocity was thus 0.7 $h^{-1}$. The product from the first reactor was introduced into the second reactor. The pressure was 13.5 MPa and the product circulated at a space velocity of 1.5 $h^{-1}$. At the end of the second step, the conversion was 93.9% of 385⁻° C. fraction as indicated in Table 2 below. The operating temperature in the first reactor was regulated to completely denitrogenate the feed and the nitrogen content of the effluent at the outlet from this step was 3 ppm. Under these conditions, the conversion was 25% by weight of 385° C.⁻.

TABLE 2

| Data for first and second step | |
|---|---|
| Temperatures | |
| First fixed bed step | 395° C. |
| Second fixed bed step | 375° C. |
| 385° C⁻. conversion (weight %) | 93.9% |
| Material balance (weight %) | |
| $H_2S + NH_3$ | 2.89 |
| C1–C4 | 4.08 |
| C5-135° C. (gasoline) | 21.93 |
| 135–385° C. (diesel cut) | 65.0 |
| 385⁺° C. | 8.92 |
| Total | 102.82 |
| Product characteristics | |
| C5-135° C. (gasoline) | |
| d15/4 | 0.698 |
| Sulphur (ppm by weight) | 2 |
| P/N/A (weight %) | 66/32/2 |
| 135–385° C. (diesel cut) | |
| d 15/4 | 0.805 |
| Sulphur (ppm by weight) | 10 |
| Cetane number | 57 |
| 385⁺° C. | |
| d 15/4 | 0.822 |
| Viscosity at 100° C. ($m^2/s$) | $4.2 \times 10^{-4}$ |
| Viscosity index after dewaxing with MIBK | 125 |
| Oil pour point (° C.) | −18 |

MIBK = methylisobutylketone; P/N/A = paraffins/naphthenes/aromatics

With these very severe conditions for operating with a heavy feed and a high degree of conversion, the deactivation of the catalytic system used and the 5 selectivity towards middle distillates as the ratio of the middle distillates fraction (135–385° C.) produced divided by the quantity of product converted (385⁻° C.), which are two important parameters of the process, are shown in Table 3:

TABLE 3

| Cycle duration data | |
|---|---|
| Deactivation of first catalyst (° C./month) | 1° C. |
| Deactivation of second catalyst (° C./month) | 0.5° C. |
| Total cycle duration (month) | 30 |
| Selectivity for 135–385⁻° C. (weight %) | 65 |

It can be seen that:

For an end cycle temperature corresponding to the metallurgical limit of the reactors (generally 425° C.), the cycle duration is always limited by the first reactor since the cycle duration of the second catalyst is potentially much longer. It is possible to increase the volume of the first catalyst to limit deactivation, but this is to the detriment of minimal investment which is normally the yardstick in constructing industrial units.

The selectivity towards middle distillates was 65% by weight.

Example 2

(in accordance with the invention)

The feed of Example 1 was introduced into a reactor, operating as an ebullating bed with addition and extraction of catalyst, containing the catalyst of Example 1, using the same pressure and space velocity conditions. The $H_2$/HC ratio was 500 by volume. Under the operating conditions of the first reactor, the nitrogen content of the effluent at the outlet from that step was 12 ppm by weight. Under these conditions, the conversion was 45% by weight of 385⁻° C.

The product from the first reactor was introduced into the second reactor operating as a fixed bed under the same pressure, space velocity and $H_2$/HC volume ratio as Example 1. The temperature was adjusted to obtain a level of conversion very close to that shown in Example 1 (93.9% of 385⁻° C.), as shown in Table 4.

TABLE 4

| Data for first and second step | |
|---|---|
| Temperatures | |
| First ebullating bed step | 415° C. |
| Second fixed bed step | 365° C. |
| 385° C⁻. conversion (weight %) | 93.8% |
| Material balance (weight %) | |
| $H_2S + NH_3$ | 2.89 |
| C1–C4 | 4.0 |
| C5-135° C. (gasoline) | 19.2 |
| 135–385° C. (diesel cut) | 67.7 |
| 385⁺° C. | 9.0 |
| Total | 102.79 |
| Product characteristics | |
| C5-135° C. (gasoline) | |
| d15/4 | 0.697 |
| Sulphur (ppm by weight) | 3 |
| P/N/A (weight %) | 65/33/2 |
| 135–385° C. (diesel cut) | |
| d 15/4 | 0.806 |
| Sulphur (ppm by weight) | 12 |
| Cetane number | 56 |
| 385⁺° C. | |
| d 15/4 | 0.823 |
| Viscosity at 100° C. ($m^2/s$) | $4.25 \times 10^{-4}$ |
| Viscosity index after dewaxing with MIBK | 123 |
| Oil pour point (° C.) | −17 |

Under these operating conditions, addition and extraction of catalyst in the first reactor meant that the cycle duration of this catalyst was not a limiting factor. Further, it was possible to operate at a higher temperature which increased the conversion in the first step, and thus the selectivity for middle distillates was higher for the process of the invention. Deactivation of the second catalyst remained at the same level which meant that the overall cycle duration could be doubled and thus was only limited by stoppages required to check the pressurised units (Table 5):

TABLE 5

| Cycle duration data | |
|---|---|
| Deactivation of second catalyst (° C./month) | 0.5° C. |
| Total cycle duration (month) | >60 |
| Selectivity for 135–385⁻° C. (weight %) | 67.7 |

It can be seen that:

For an end cycle temperature corresponding to the metallurgical limit of the reactors (generally 425° C.), the total cycle duration was more than doubled using the process of the invention, allowing the potential of the zeolitic catalyst to be exploited to the full.

The selectivity for middle distillates was 67.7% by weight which represents a supplemental advantage when the aim is to maximise the production of middle distillates.

Example 3

(in accordance with the invention)

The feed of Example 1 was introduced into a reactor, operating as an ebullating bed with addition and extraction of catalyst, containing the catalyst of Example 1, using the same pressure, $H_2$/HC and space velocity as in Example 2. Under the operating conditions of the first reactor, the nitrogen content of the effluent at the outlet from that step was 12 ppm by weight. Under these conditions, the conversion was 45% by weight of 385⁻° C.

The product from the first reactor was fractionated to recover the gasoline cut and the diesel cut which had already been converted and only the unconverted 385⁺° C. fraction was introduced into the second reactor operating as a fixed bed under the same pressure and space velocity conditions, which reduced the catalytic volume of this reactor compared with Examples 1 and 2. The temperature was adjusted to obtain a level of conversion very close to that shown in Example 1 (93.9% of 385⁻° C.), as shown in Table 6.

TABLE 6

| Data for first and second step | |
|---|---|
| Temperatures | |
| First ebullating bed step | 415° C. |
| Second fixed bed step | 368° C. |
| 385° C⁻. conversion (weight %) | 94.25% |
| Material balance (weight %) | |
| $H_2S + NH_3$ | 2.89 |
| C1–C4 | 3.8 |
| C5-135° C. (gasoline) | 18.0 |
| 135–385° C. (diesel cut) | 69.5 |
| 385⁺° C. | 8.56 |
| Total | 102.75 |
| Product characteristics | |
| C5-135° C. (gasoline) | |
| d15/4 | 0.698 |
| Sulphur (ppm by weight) | 5 |
| P/N/A (weight %) | 65/32/3 |
| 135–385° C. (diesel cut) | |
| d 15/4 | 0.808 |
| Sulphur (ppm by weight) | 15 |
| Cetane number | 54 |
| 385⁺° C. | |
| d 15/4 | 0.824 |
| Viscosity at 100° C. ($m^2/s$) | $4.30 \times 10^{-4}$ |
| Viscosity index after dewaxing with MIBK | 122 |
| Oil pour point (° C.) | −15 |

Under these operating conditions, the selectivity for middle distillates was still further improved with respect to Example 2 since the products which had already been converted could not be re-cracked in the fixed bed reactor and selectivity was maximised. The overall cycle duration was not affected by this variation of the process (Table 7):

TABLE 7

| Cycle duration data | |
|---|---|
| Deactivation of second catalyst (° C./month) | 0.6° C. |
| Total cycle duration (month) | >60 |
| Selectivity for 135–385⁻° C. (weight %) | 69.5 |

It can be seen that:

The selectivity for middle distillates was 69.5% by weight which represents a supplemental advantage when the aim is to maximise the production of middle distillates.

What is claimed is:

1. A process for converting a hydrocarbon feed fraction with a sulphur content of at least 0.05% by weight with an initial boiling point of at least 300° C. and an end point of at least 400° C., comprising the following steps:

a) treating the hydrocarbon feed in a hydrotreatment section in the presence of hydrogen, said section comprising at least one three-phase reactor, containing at least one ebullating bed of hydrotreatment catalyst the mineral support of which is at least partially amorphous, functioning in riser mode for liquid and for gas, extracting catalyst from a location near the bottom of the reactor and adding fresh catalyst to said reactor at a location near the top of the reactor, and withdrawing resultant hydrotreated effluent from said reactor;

a1) splitting the resultant hydrotreated effluent into a heavy liquid fraction and a lighter fraction, and recovering said lighter fraction;

b) sending at least a portion of the heavy liquid fraction from step a1) to a hydrocracking section for treatment in the presence of hydrogen, said section comprising at least one reactor containing at least one fixed bed of hydrocracking catalyst comprising a mineral support, under hydrocracking conditions for producing an effluent with a reduced sulphur content and a higher middle distillates content; and b1) separating to at least partially eliminate fines contained in either the effluent from step a) before introducing the effluent from step a) into a1) or the heavy liquid fraction from step a1) before introducing the heavy liquid fraction into step b).

2. A process according to claim 1, in which at least a portion of the effluent obtained from step b) is sent to a distillation zone (step c)) from which a gas fraction, a gasoline engine fuel fraction, a diesel engine fuel fraction and a liquid fraction which is heavier than the diesel fraction are recovered.

3. A process according to claim 2, in which the liquid fraction which is heavier than the diesel fraction obtained from step c) is sent to a catalytic cracking section (step d)) in which it is treated under conditions for recovering a gas fraction, a gasoline fraction, a diesel fraction and a slurry fraction.

4. A process according to claim 3, in which at least a portion of the diesel fraction recovered at catalytic cracking step d) is recycled to the ebullated bed of step a).

5. A process according to claim 3, in which catalytic cracking step d) is carried out under conditions which can produce a gasoline fraction at least a portion of which is sent to the gasoline pool, a diesel fraction at least a portion of which is sent to the diesel pool and a slurry fraction at least a portion of which is sent to the heavy fuel pool.

6. A process according to claim 3, in which at least a portion of the diesel fraction and/or the gasoline fraction obtained from catalytic cracking step d) is recycled to the inlet to said step d).

7. A process according to claim 3, in which at least a portion of the slurry fraction obtained at catalytic cracking step d) is recycled to the inlet to said step d).

8. A process according to claim 3, in which at least a portion of said slurry fraction is returned to the ebullated bed of hydrotreatment step a).

9. A process according to claim 2, in which at least a portion of the liquid fraction which is heavier than the diesel fraction obtained in step c) is returned to the ebullated bed of hydrotreatment step a).

10. A process according to claim 2, in which the lighter fraction which is recovered is sent to the distillation zone of step c).

11. A process according to claim 2, in which at least a portion of the liquid fraction which is heavier than the diesel fraction obtained in step c) is sent to the heavy fuel pool.

12. A process according to claim 1, in which the gasoline engine fuel fraction and the diesel engine fuel fraction obtained in step c) are sent at least in part to their respective gasoline pools.

13. A process according to claim 1, in which the lighter fraction which is recovered is sent to a distillation zone from which a gas fraction, a gasoline engine fuel fraction, a diesel engine fuel fraction and a liquid fraction which is heavier than the diesel fraction are recovered.

14. A process according to claim 13, in which at least a portion of the liquid fraction which is heavier than the diesel fraction is returned to the ebullated bed of step a).

15. A process according to claim 1, in which the separation step comprises using two separation means in parallel, one of which is used to carry out separation while the other is purged of retained fines.

16. A process according to claim 1, in which during step a), the treatment in the presence of hydrogen is carried out at an absolute pressure of 2 to 35 MPa, a temperature of about 300° C. to 550° C., an hourly space velocity of about 0.1 to 10 $h^{-1}$, and the quantity of hydrogen mixed with the feed is about 50 to 5000 $Nm^3/m^3$.

17. A process according to claim 1, in which hydrocracking step b) is carried out at an absolute pressure of 2 to 30 MPa, a temperature of about 300° C. to 500° C., an hourly space velocity of about 0.1 to 10 $h^{-1}$, and the quantity of hydrogen mixed with the feed is about 50 to 5000 $Nm^3/m^3$.

18. A process according to claim 1, in which the feed which is treated is a vacuum distillate from vacuum distillation of an atmospheric distillation residue of a crude oil and the vacuum residue is sent to a deasphalting step f) from which a deasphalted oil is recovered, at least a portion of which is sent to step a), and asphalt is recovered.

19. A process according to claim 18, in which deasphalting is carried out at a temperature of 60° C. to 250° C. with at least one hydrocarbon solvent containing 3 to 7 carbon atoms.

20. A process according to claim 1, wherein the initial boiling point of the hydrocarbon feed is at least 320° C., and the sulfur content is at least 1% by weight.

21. A process according to claim 1, wherein the initial boiling point of the hydrocarbon feed is at least 340° C., and the sulfur content is at least 2% by weight.

* * * * *